US006050668A

United States Patent [19]

Ikado

[11] Patent Number: 6,050,668

[45] **Date of Patent: *Apr. 18, 2000**

[54] INK JET RECOVERY PUMP WITH VARIABLE DRIVING CONDITIONS

[75] Inventor: Masaharu Ikado, Suita, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/362,999

[22] Filed: Dec. 23, 1994

[30] Foreign Application Priority Data

Dec. 27, 1993 [JP] Japan ..... 5-331100
Dec. 27, 1993 [JP] Japan ..... 5-331102

[51] Int. Cl.[7] ..... B41J 2/165

[52] U.S. Cl. ..... 347/23; 347/30

[58] Field of Search ..... 347/23, 29, 30, 347/31, 32

[56] References Cited

U.S. PATENT DOCUMENTS

| | | | |
|---|---|---|---|
| 4,967,204 | 10/1990 | Terasawa et al. | 347/23 |
| 5,153,614 | 10/1992 | Yamaguchi et al. | 347/30 |
| 5,245,362 | 9/1993 | Iwata et al. | 347/23 |
| 5,298,923 | 3/1994 | Tokunaga et al. | 347/23 |
| 5,357,275 | 10/1994 | Ikado et al. | 347/31 |
| 5,389,961 | 2/1995 | Takagi | 347/29 |

FOREIGN PATENT DOCUMENTS

| | | | |
|---|---|---|---|
| 0 540 174 | 5/1993 | European Pat. Off. | B41J 2/165 |
| 0 540 344 | 5/1993 | European Pat. Off. | B41J 2/165 |
| 3-183556 | 8/1991 | Japan | B41J 3/04 |
| 6-262772 | 9/1994 | Japan | 347/30 |

OTHER PUBLICATIONS

Humphries et al, Industrial Electronics 2nd Ed., 1986, pp. 208–237.

*Primary Examiner*—John Barlow
*Assistant Examiner*—Craig A. Hallacher
*Attorney, Agent, or Firm*—Fitzpatrick, Cella, Harper & Scinto

[57] ABSTRACT

To eliminate sticking problems caused by ink thickening inside a pump while the pump is on standby, a driving force and/or a drive sequence by which, in a case in which the pump for expelling ink from the discharge port of an ink jet head is not driven for a predetermined time, the pump is driven differently from its normal operation.

37 Claims, 7 Drawing Sheets

INK JET RECOVERY PUMP WITH VARIABLE DRIVING CONDITIONS

BACKGROUND OF THE INVENTION

1. Field of the Invention

The present invention relates to an ink jet apparatus having a pump for maintaining ink discharge from a discharge port of an ink jet head in a satisfactory condition and for discharging ink from the discharge port in order to recover such a condition, and a method of driving the ink jet apparatus.

2. Description of the Related Art

As a pump for an ink expelling means mounted in a recovery system of an ink jet recording apparatus, a plunger pump has mainly been formed, for example, into a unit. In such a pump, the contact seal surface between a piston which reciprocates inside the cylinder and the cylinder is in close contact with the inner surface of the cylinder. A seal member provided between the piston and the cylinder is in close contact with the shaft (plunger) of the piston.

In such a conventional ink jet recording apparatus, there is a case in which ink deposited on the contact seal surface of the piston and a seal member is thickened, for example, after the ink jet recording apparatus is left to stand for a long period of time. Also, since pressure is applied to the contact seal surface of the piston all the time so that the piston is brought into close contact with the inner surface of the cylinder, the piston can become stuck fast to the inner surface of the cylinder by the thickened ink. Further, since pressure is applied to seal member all the time so as to be brought into close contact with the plunger, the seal member can become stuck fast to the plunger by thickened ink.

As a result, when the pump is driven after the ink jet apparatus is left to stand for some time, the pump can be stuck fast to an extent exceeding the drive energy generated by the pump drive source, thus making the apparatus inoperable, and requiring a service call. Since this causes the reliability of the apparatus to be reduced considerably, one solution is to increase the driving force of the drive source more than is normally required so as to drive the pump unit even if the pump is stuck fast. However, extra energy is consumed when the pump is not stuck fast, and the extra energy results mainly in increased noise, which is problematical. When, in particular, a water resistant ink with a relatively high proportion of volatile components, is used, the above-described problem is more likely to occur.

SUMMARY OF THE INVENTION

It is an object of the present invention to provide an ink jet apparatus having a high degree of reliability in which wasteful consumption of energy and the occurrence of noise are suppressed and thus the above-described problem does not occur, and a method of driving the ink jet apparatus.

It is another object of the present invention to provide an ink jet apparatus in which the driving force of the drive source of a pump needs only to be a driving force of an appropriate scale and thus extra energy is not consumed to drive the pump, and noise is scarcely generated, and to provide a pump for the ink jet apparatus.

To achieve the above-described object, according to one aspect of the present invention, there is provided an ink jet apparatus, comprising: a pump for expelling ink from the discharge port of an ink jet head; and drive means for making the driving force for the pump different in response to the time during which the pump is not driven.

According to another aspect of the present invention, there is provided a method of driving an ink jet apparatus having a pump for expelling ink from the discharge port of an ink jet head, the method comprising the step of: making a driving force for driving the pump different in response to the time during which the pump is not driven.

According to the present invention, since the pump is driven by a driving force larger than in normal times when the pump is driven at the first time after the ink jet apparatus is left in a non-use state for a long period of time, it is possible to easily activate the pump even if the parts of the pump are stuck fast by ink. Since the pump is driven by an appropriate amount of a driving force which is necessary and sufficient during normal pump driving, extra energy is not consumed, or noise is not generated. Therefore, according to the present invention, it is possible to obtain an ink jet apparatus having a high degree of reliability and a method of driving the ink jet apparatus.

Also, according to the present invention, since the pump is driven by a drive sequence such that there is an impact larger than in normal times when the pump is driven at the first time after the ink jet apparatus is left in a non-use state for a long period of time, it is possible to easily activate the pump even if the parts of the pump are stuck fast by ink. Since the pump is driven by a drive sequence which is necessary and sufficient and of an appropriate scale during normal pump driving, extra energy is not consumed, and noise is not generated. Therefore, according to the present invention, it is possible to obtain an ink jet apparatus having a high degree of reliability and a method of driving the ink jet apparatus.

The above objects, aspects and novel features of the invention will more fully be appreciated from the following detailed description when read in connection with the accompanying drawings.

DETAILED DESCRIPTION OF THE PREFERRED EMBODIMENTS

Preferred embodiments of the present invention will be explained below with reference to the accompanying drawings.

Figure 2:
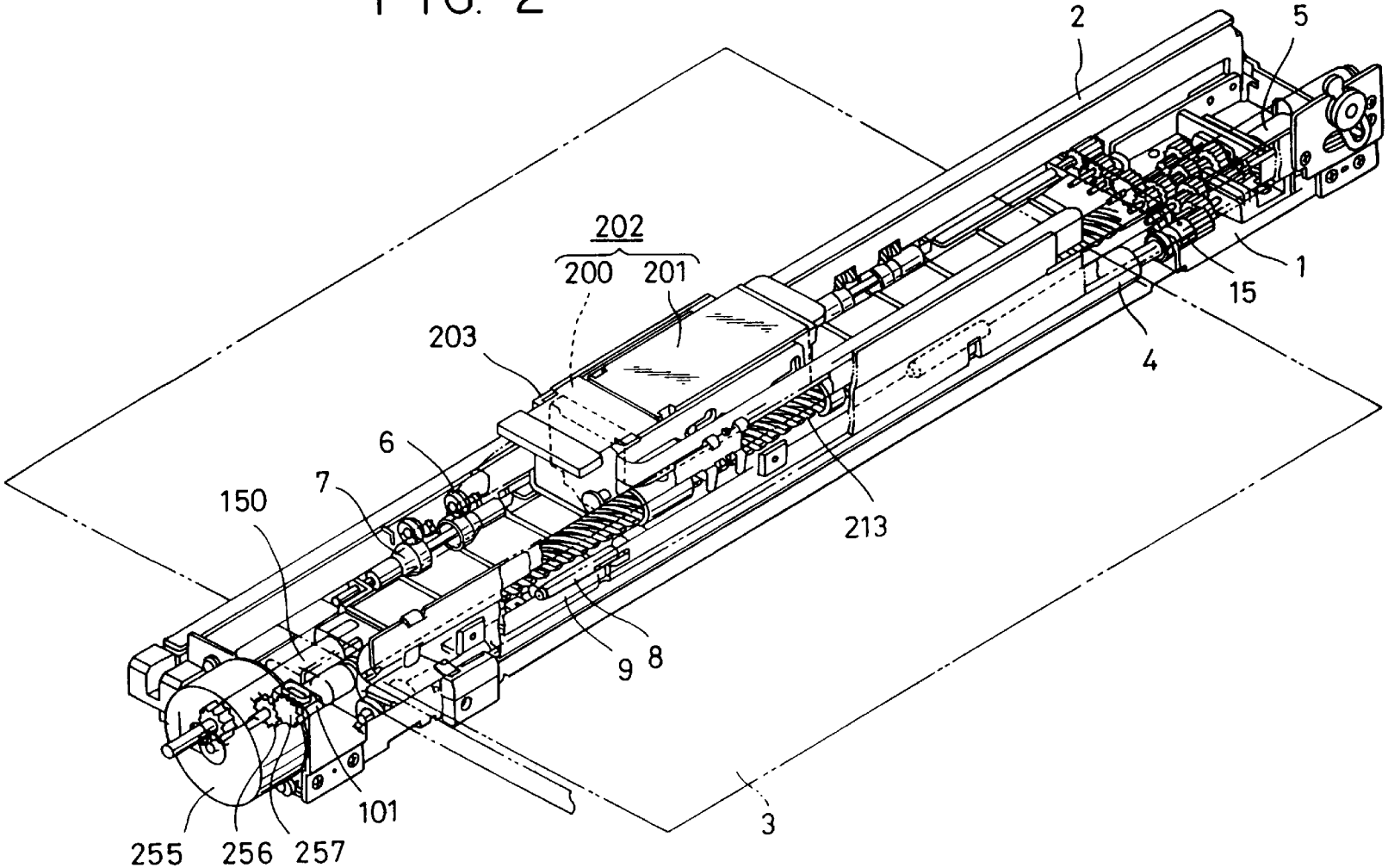
FIG. 2 is a perspective view illustrating the essential portion of an ink jet apparatus in accordance with the present invention.

FIG. 2 is a perspective view illustrating an essential portion of an ink jet apparatus in accordance with one embodiment of the present invention. Referring to FIG. 2, a carrier 203 has a head cartridge 202 mounted therein, in which head cartridge an ink jet head (recording head) 200 is connected to an ink tank 201, which elements constitute recording means. One end of the ink jet head 200 of the carrier 203 is slidably engaged with a lead screw 213 which is rotatably mounted in a chassis 1 along the axis of the lead screw 213. A guide is disposed in the other end of the carrier 203. The guide is slidably inserted into a guide rail 2 formed in the chassis 1 in parallel to the axis of the lead screw 213. The carrier 203 is arranged to reciprocate along the axis of the lead screw 213 as the lead screw 213 rotates while the posture of the carrier 203 is maintained constant.

Figure 3:
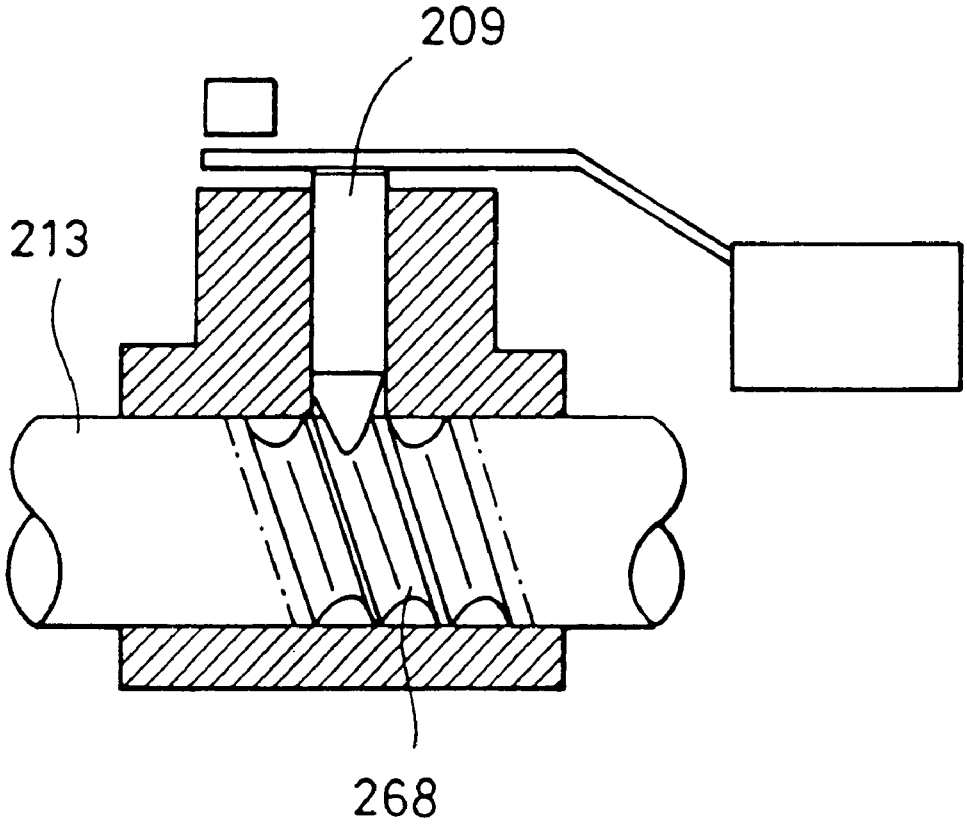
FIG. 3 is an enlarged, perspective view illustrating a carrier bearing in accordance with the present invention.

As shown in FIG. 2, a lead screw gear 257 fixedly secured to the left end of the lead screw 213 is engaged with a pinion gear 256 fixedly secured to the output axis of a carrier motor 255. Also, as shown in FIG. 3, a lead pin 209 mounted in the carrier 203 is fitted into a guide source 268 formed at a predetermined pitch in a helical form in the lead screw 213. Therefore, when the lead screw 213 rotates as the carrier motor 255 is driven forwardly or backwardly, the carrier 203 reciprocates.

FIG. 3 is an enlarged, perspective view illustrating a carrier bearing section in accordance with the embodiment of the present invention.

This ink jet apparatus performs one-line recording on a recording material 3 when the recording head 200 is driven in synchronization with the reciprocation of the carrier 203, and ink is discharged in response to recording signals. The recording head 200 is formed with an ink discharge port, an ink passage connected to the discharge port, and energy generating means for generating energy used to discharge ink. Examples of energy generating means include electro-mechanical conversion members, such as piezo-electric elements, means for radiating electromagnetic waves, such as lasers, to the ink, and electro-thermal conversion members, such as heating elements, for generating thermal energy. A recording head provided with thermal energy generating means as the energy generating means is capable of performing high-resolution recording because the discharge port can be arranged at high densities. A recording head provided with an electro-thermal conversion member can be easily formed compact, and has the advantages of being capable of fully utilizing recent advances in the semiconductor field, IC technology, and micromachining technology which have improved considerably in reliability, and of being easy to form for high-density mounting and inexpensive to manufacture.

When one line of recording is performed by scanning the carrier 203, the recording material 3 is transported by one line by transport means, and recording is performed on the next line. The recording material 3 is transported by a rotary pair of transport rollers 4 and a pinch roller 8, and a rotary pair of exit rollers 7 and a spur 6 in contact with the exit roller 7. This transportation will now be explained specifically. The recording material 3 whose recording surface faces the discharge port surface of the recording head 200 is brought into pressure contact with the transport rollers 4 by the pinch roller 8, and the transport rollers 4 are rotated appropriately by a feeder motor 5. Thus, the recording material 3 is transported as required to the recording position. After recording, the recording material 3 is brought into pressure contact with the exit rollers 7 by the spur 6, and transported outside the apparatus as the exit rollers 7 rotate. The transport rollers 4 and the exit rollers 7 are driven by the feeder motor 5, and the driving force is transmitted by a reduction gear train 15.

Figure 4:
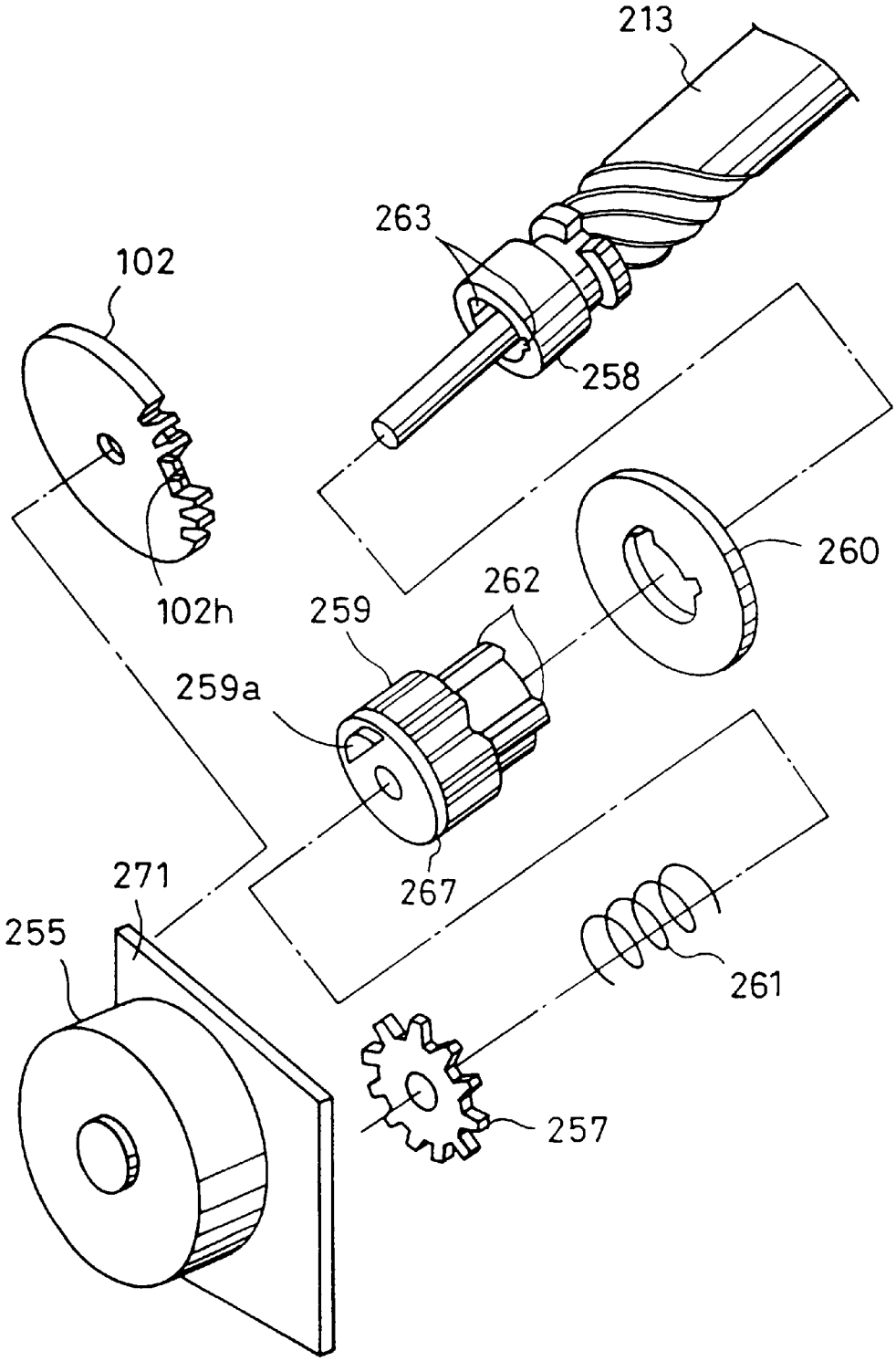
FIG. 4 is an exploded, perspective view illustrating the left end portion of a lead screw including a clutch mechanism in accordance with the present invention.

FIG. 4 is an exploded, perspective view illustrating the left end portion of the lead screw 213, including a clutch for transmitting the driving force of the carrier motor 255 to the recovery system via the lead screw 213. Disposed at the left end of the lead screw 213 are an initial lock 258, a clutch plate 260, a clutch gear 259, and a return spring 261. The initial lock 258 is fixed to the lead screw 213. The clutch gear 259 is slidably engaged with the lead screw 213 in such a manner as to be axially slidable thereon, and a part of the clutch gear 259 is inserted into the interior of the initial lock 258. More specifically, projections 262 are formed at two places of the circumference of the clutch gear 259 at non-symmetrical positions. These projections 262 are engaged with recesses 263 formed in the initial lock 258 in phase with the projections 262 in such a manner as to be movable only along the axis.

A flange 267 is disposed on the end surface of the lead screw gear 257 of the clutch gear 259. A trigger tooth 259*a* is formed on the flange 267 for supplying a rotational trigger to a control gear 102. The control gear 102 has gears formed on the outer circumference thereof, and when the lead screw 213 is assembled into a recovery system plate 271, it is engaged with the clutch gear 259 on the lead screw 213. During a recording operation, however, that portion of the control gear 102 where a part of the gear on the outer circumference is cut out faces the clutch gear 259, and the control gear 102 will not be engaged with the clutch gear 259. A side gear 102*h* with several teeth is formed on the side of the portion where the gear is cut out. The side gear 102*h* is engaged with the trigger tooth 259*a* of the clutch gear 259, thus supplying a rotational trigger to the control gear 102.

Figure 5:
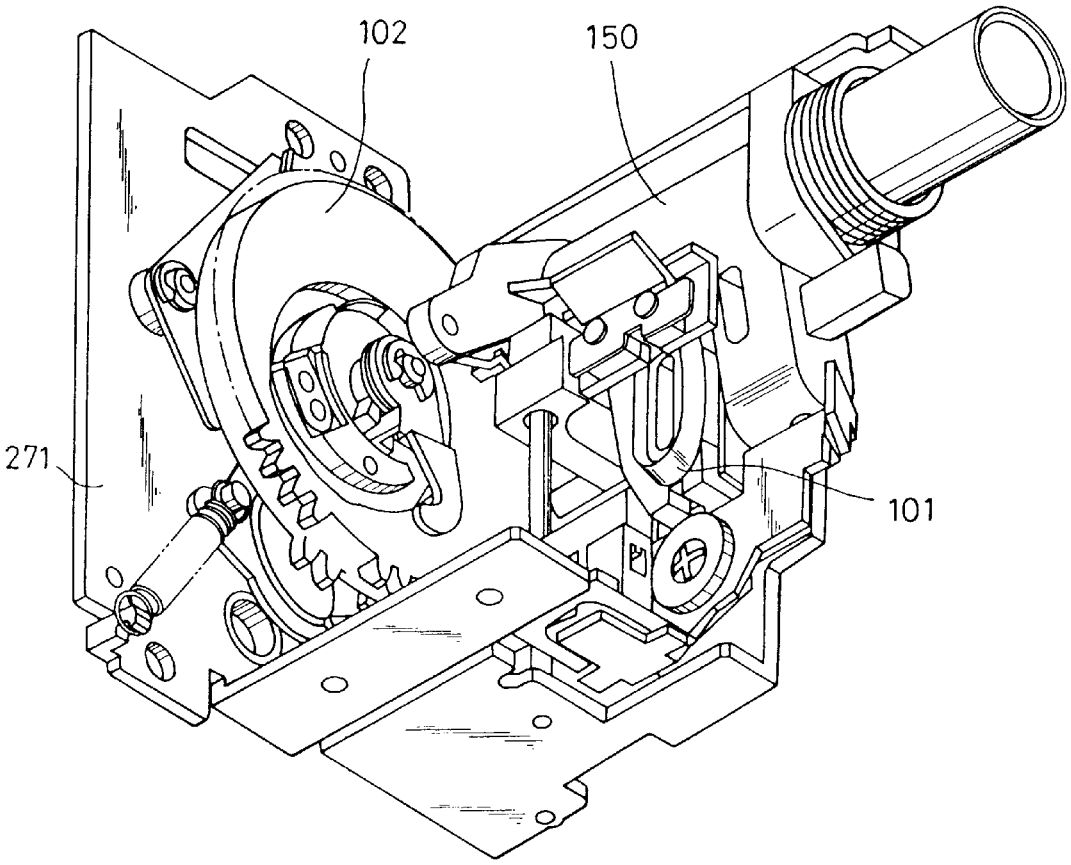
FIG. 5 is a perspective view illustrating a recovery system unit in accordance with another embodiment the present invention.

FIG. 5 is a perspective view illustrating a recovery system unit in accordance with the present invention. Shown in FIG. 5 are a cap 101 for capping the discharge port surface of the recording head 200; a pump unit 150 for sucking ink from the discharge port via the cap 101 and sending the ink to a waste ink absorber as a result of the interior of the pump unit 150 being subjected to a negative pressure; and the control gear 102 of the transmission mechanism section formed of a cam and a gear mechanism for causing the cap 101 to move back and forth with respect to the discharge port surface, for transmitting a driving force to the pump unit 150, and for operating a wiping mechanism for wiping ink deposited on the discharge port surface. The rotational driving force of the carrier motor 255 is transmitted to the control gear 102 via the clutch gear 259. A pulse motor is used as the carrier motor 255, which drives the main scanning of the carrier and the recovery mechanism.

Figure 6:
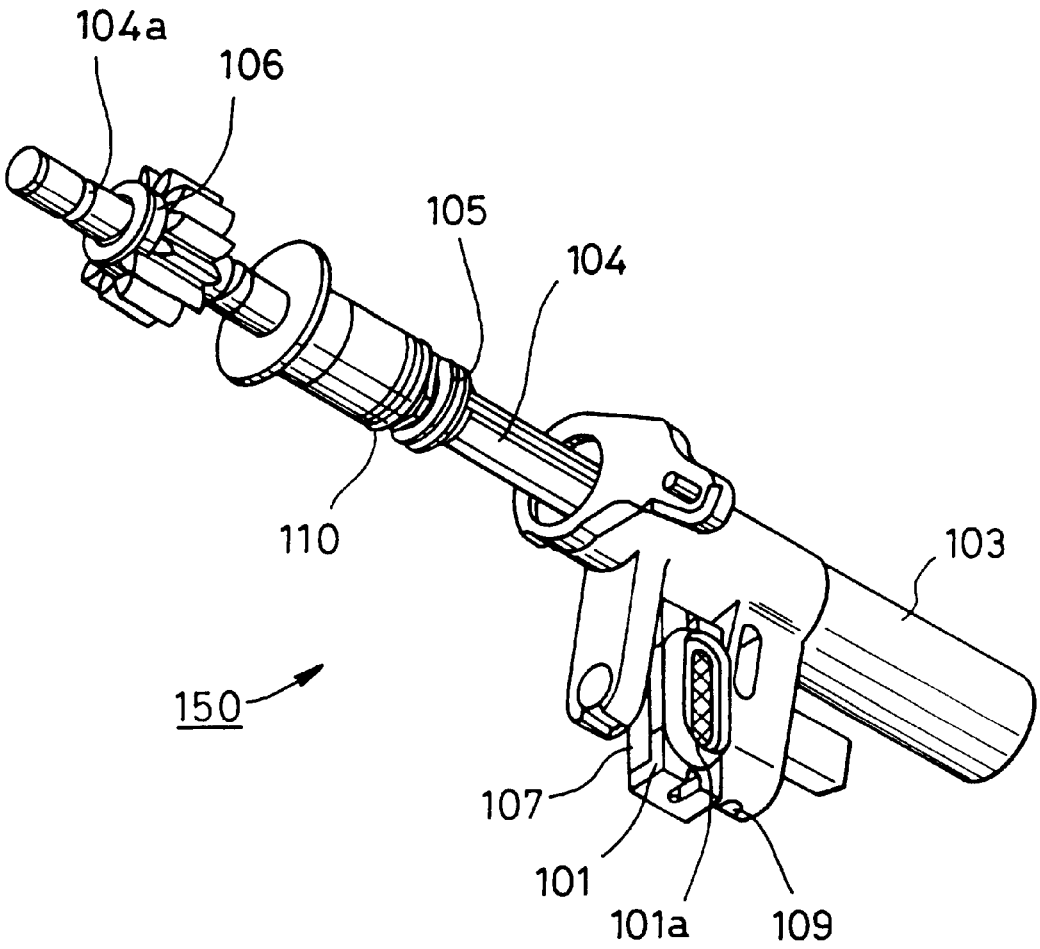
FIG. 6 is an exploded, perspective view illustrating a pump unit in accordance with the present invention.

FIG. 6 is an exploded, perspective view illustrating a pump unit in accordance with the present invention. The pump unit 150 is formed into a plunger pump. This pump comprises the cylinder 103, a piston for causing a pressure change, by which ink is expelled from the discharge port of the recording head, to be generated in the inner space formed by the piston in close contact with the cylinder, and a pump seal 110 provided between the shaft 104 of the piston and the cylinder in such a manner as to be in close contact with them. The piston has a shaft 104 and an elastic member 105 which is loosely engaged with the shaft 104. For the sake of convenience, the shaft 104 is called a plunger, and the elastic member 105 is called a piston. The cylinder 103 and the plunger 104 are formed of polyoxymethylene (POM), and the piston 105 and the pump seal 110 are formed of silicone rubber.

As a result of the piston 105 mounted in the plunger 104 reciprocating inside the cylinder 103 in a state in which the discharge port of the recording head 200 is covered with the cap 101, a negative pressure is generated in the interior, ink is sucked from the recording head 200 via the cap 101 and an ink suction port 103*a*, and thus the discharging function is recovered or maintained in a satisfactory condition. The piston 105 is made to reciprocate by the rotation of a stroke gear 106, having projections that engage with a lead groove 104*a* in the plunger 104. Furthermore, the rotational force of the stroke gear 106 is imparted by engagement with the control gear 102, and as a result, rotational driving force is transmitted from the carrier motor 255.

The cap 101 can be brought into close contact with and separated from the recording head 200 by means of the cam of the control gear 102. Generally speaking, the cap is formed of an elastic member having low gas permeability and high resistance to ink. In this embodiment, the cap is formed of chlorinated butyl rubber. The pump seal 110 is in close contact with the inner circumference of the cylinder 103 and the outer circumference of the plunger 104, and is an elastic seal member provided to realize a closed space in the pump. A cap lever 107 is a member for coupling the cap 101 to the interior of the cylinder 103, and an ink passage is disposed therein. The ink passage is sealed midway by a cap lever seal and an stainless steel (SUS) ball 109, and thus air tightness is assured between an ink suction port of the cylinder and the close-contact surface 101*a* of the cap 101 with the recording head.

Figure 1:
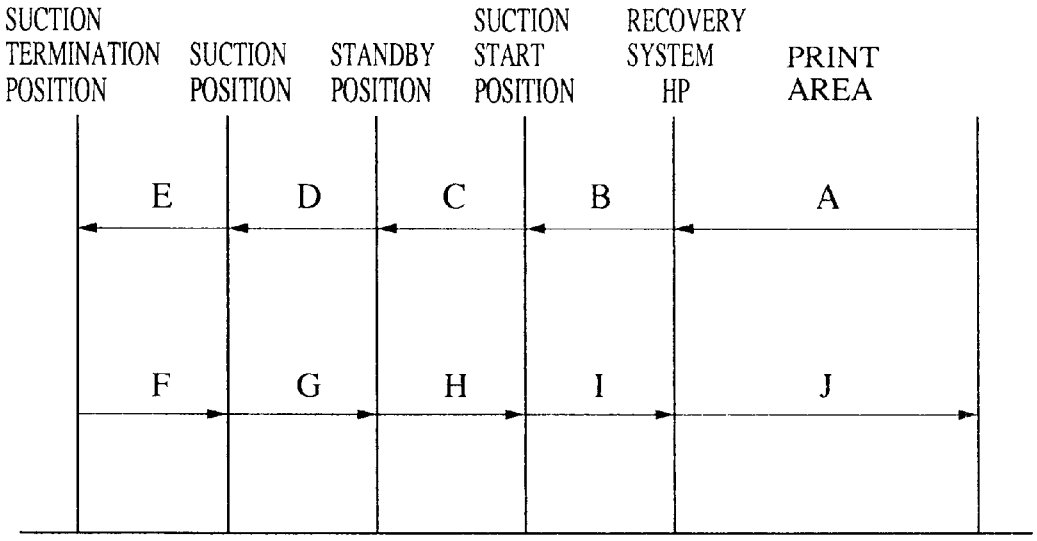
FIG. 1 is a diagram illustrating the drive sequence of a pump in accordance with one embodiment of the present invention.

FIG. 1 is a diagram illustrating the drive sequence of a pump in accordance with an embodiment of the present invention. Since a carrier motor formed of a pulse motor is also used to drive the recovery mechanism in this embodiment, in FIG. 1, the word "position", such as "suction position", denotes the rotational angle of the motor corresponding to the number of pulses. The drive sequence of the pump can be explained on the basis of the steps "A" to "J" of FIG. 1. After normal printing (A) is terminated, and until the next printing signals are received, the main body of the apparatus, including the pump, is on standby at "standby position" after passing "recovery system HP (home position)" and "suction start position" (B, C). When use of the apparatus is stopped and the power supply is shut down, the apparatus is left in the "standby position" state. At the "standby position", the discharge port of the head is capped by the cap. When the next print instruction is input, the apparatus immediately passes from "H" through "I" back to "J" where printing is performed.

When a suction instruction is received or the power supply of the apparatus is turned on again, initially, driving step "H" of FIG. 1 is performed at first. At the "suction start position", the piston of the pump is at the top dead point, and at "standby position", the piston of the pump is at a position slightly moved toward the bottom dead point from the top dead point. For this reason, the driving step "H" is performed to gain piston stroke. Thereafter, the apparatus is driven in alphabetical order from "C" to "J". Since at the "standby position" the piston moves to the position of the suction port of the pump connected to the discharge port of the head via the cap, the suction chamber (the negative-pressure generating chamber) inside the pump is connected to the discharge port, and suction is performed from the discharge port. At the "suction termination position", the piston is at the bottom dead point. The motor is driven by the carrier motor rotating forwardly from "F" to "J", and driven by the carrier motor rotating backwardly from "A" to "E".

In the first embodiment, by making the drive frequency of the pulse motor in normal times different from that at the first time after the ink jet apparatus is left to stand more than one week (168 hours), the initial driving force of the pump is increased. To be specific, at step "H" in FIG. 1, the ink jet apparatus, which is driven by a motor for 146 steps at a frequency of 300 pps (pulses per second), a voltage of 14.0 DCV, and an electric current of 275 mA in normal times, is driven with the frequency 100 pps (the other conditions being the same as in normal times) after the ink jet apparatus is left to stand more than one week (168 hours). As a result, since a large pump driving force can be obtained, sticking of the pump is satisfactorily eliminated and the pump can be driven.

In a second embodiment, by making the drive voltage of the pulse motor in normal times different from that at the first time after the ink jet apparatus is left to stand more than one week (168 hours), the initial driving force of the pump after is increased. To be specific, at step "H" in FIG. 1, the ink jet apparatus, which is driven by a motor under the same conditions as in normal times in the first embodiment, is driven with the voltage being increased to 20 DCV (the other conditions being the same as in normal times) after the ink jet apparatus is left more than one week (168 hours). As a result, since a large pump driving force can be obtained, sticking of the pump is satisfactorily eliminated and the pump can be driven.

In a third embodiment, by making the drive current of the pulse motor in normal times different from that at the first time after the ink jet apparatus is left to stand more than one week (168 hours), the initial driving force of the pump is increased. To be specific, at step "H" in FIG. 1, the ink jet apparatus, which is driven by a motor under the same conditions as in normal times in the first embodiment, is driven with the current being increased to 400 mA (the other conditions being the same as in normal times) after the ink jet apparatus is left more than one week (168 hours). As a result, since a large pump driving force can be obtained, sticking of the pump is satisfactorily eliminated and the pump can be driven.

In a fourth embodiment, by making both the drive frequency and the drive voltage of the pulse motor in normal times different from those at the first time after the ink jet apparatus is left more than one week (168 hours), the initial driving force of the pump is increased. To be specific, at step "H" in FIG. 1, the ink jet apparatus, which is driven by a motor under the same conditions as in normal times in the first embodiment, is driven with the frequency being decreased to 100 pps and the voltage being increased to 20 DCV (the other conditions being the same as in normal times) after the ink jet apparatus is left more than one week (168 hours). As a result, since a large pump driving force can be obtained, sticking of the pump is satisfactorily eliminated and the pump can be driven.

In a fifth embodiment, by making both the drive frequency and the drive current of the pulse motor in normal times different from those at the first time after the ink jet apparatus is left to stand more than one week (168 hours), the initial driving force of the pump after is increased. To be specific, at step "H" in FIG. 1, the ink jet apparatus, which is driven by a motor under the same conditions as in normal times in the first embodiment, is driven with the frequency being decreased to 100 pps and the current being increased to 400 mA (the other conditions being the same as in normal times) after the ink jet apparatus is left more than one week (168 hours). As a result, since a large pump driving force can be obtained, the sticking of the pump is satisfactorily eliminated and the pump can be driven.

In a sixth embodiment, by making both the drive voltage and the drive current of the pulse motor in normal times different from those at the first time after the ink jet apparatus is left to stand more than one week (168 hours), the initial driving force of the pump is increased. To be specific, at step "H" in FIG. 1, the ink jet apparatus, which is driven by a motor under the same conditions as in normal times in the first embodiment, is driven with the voltage being increased to 20 DCV and the current being increased to 400 mA (the other conditions being the same as in normal times) after the ink jet apparatus is left more than one week (168 hours). As a result, since a large pump driving force can be obtained, sticking of the pump is satisfactorily eliminated and the pump can be driven.

In a seventh embodiment, by making all of the drive frequency, the drive voltage and the drive current of the pulse motor in normal times different from those at the first time after the ink jet apparatus is left to stand more than one week (168 hours), the initial driving force of the pump is increased. To be specific, at step "H" in FIG. 1, the ink jet apparatus, which is driven by a motor under the same conditions as in normal times in the first embodiment, is driven with the frequency being decreased to 100 pps, the voltage being increased to 20 DCV and the current being increased to 400 mA (the other conditions are the same as in normal times) after the ink jet apparatus is left more than one week (168 hours). As a result, since a large pump driving force can be obtained sticking of the pump is satisfactorily eliminated and the pump can be driven.

In an eighth embodiment, by making the drive frequency of the pulse motor in normal times different from those at the first time after the ink jet apparatus is left to stand more than one week (168 hours) and left to stand more than two weeks (336 hours), the driving force of the pump is changed. To be specific, at step "H" in FIG. 1, the ink jet apparatus, which is driven by a motor for 146 steps at a frequency of 300 pps, a voltage of 14.0 DCV, and an electric current of 275 mA in normal times, is driven with the frequency being decreased to 100 pps after the ink jet apparatus is left more than one week (the other conditions are the same as in the normal times) and being decreased to 70 pps after it is left more than two weeks (336 hours). As a result, since a large pump driving force can be obtained after the ink jet apparatus is left for one week, and a still larger pump driving force can be obtained after the ink jet apparatus is left for two weeks, the sticking of the pump is satisfactorily eliminated and the pump can be driven.

Figure 7:
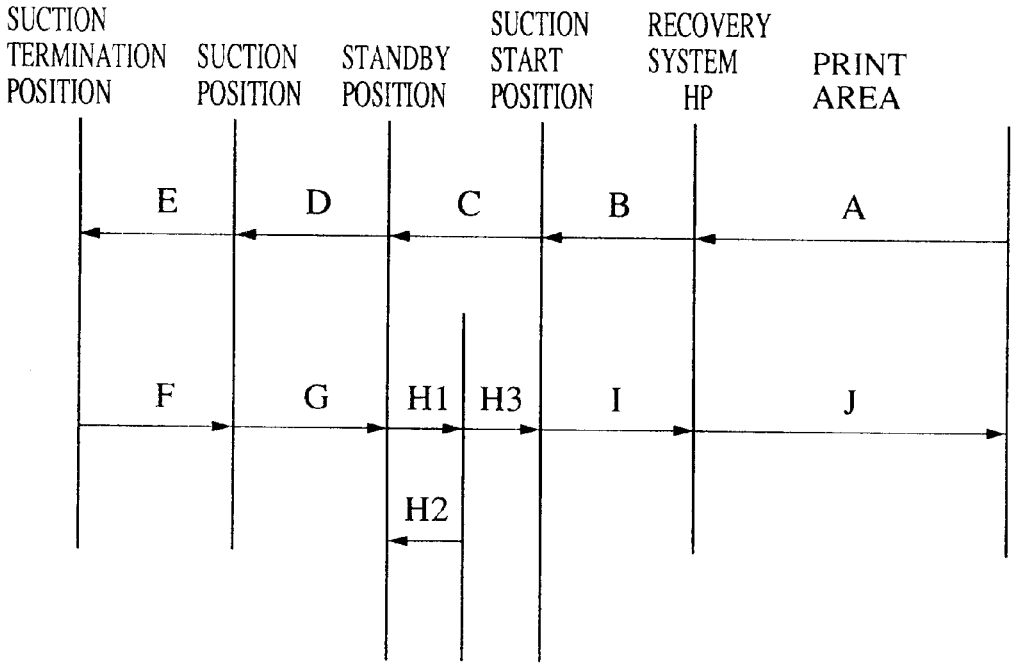
FIG. 7 is a diagram illustrating the drive sequence of a pump in accordance with another embodiment of the present invention.

FIG. 7 is a diagram illustrating the drive sequence of a pump in accordance with another embodiment of the present invention. Since a carrier motor formed of a pulse motor is also used to drive the recovery mechanism in this embodiment, in FIG. 7, the word "position", such as "suction position", denotes the rotational angle of the motor corresponding to the number of pulses. The drive sequence of the pump can be explained on the basis of the steps "A" to "J" of FIG. 7. After the normal printing (A) is terminated, and until the next printing signals are received, the main body of the apparatus, including the pump, is on standby at "standby position" after passing "recovery system HP (home position)" and "suction start position" (B, C). When use of the apparatus is stopped and the power supply is shut down, the apparatus is left in the "standby position" state. At the "standby position", the discharge port of the head is capped by the cap. When the next print instruction is input, the apparatus immediately passes from "H1+H3" through "I" back to "J" where printing is performed.

When a suction instruction is received or the power supply of the apparatus is turned on again, initially, driving of step "H1+H3" of FIG. 7 is performed first. At the "suction start position", the piston of the pump is at the top dead point, and at "standby position", the piston of the pump is at a position slightly moved toward the bottom dead point from the top dead point. For this reason, the driving step "H1+H3" is performed to gain piston stroke. Thereafter, the apparatus is driven in alphabetical order from "C" to "J". Since at the "standby position" the piston moves to the position of the suction port of the pump connected to the discharge port of the head via the cap, the suction chamber (the negative-pressure generating chamber) inside the pump is connected to the discharge port, and suction is performed from the discharge port. At the "suction termination position", the piston is at the bottom dead point. The carrier motor is driven forwardly from "F" to "J", and driven backwardly from "A" to "E".

In a ninth embodiment, by making the drive sequence of the pulse motor in normal times different from that at the first time after the ink jet apparatus is left to stand more than one week (168 hours), the drive sequence after the ink jet apparatus is left is formed into a sequence having a large impact on the pump. To be specific, at step "H1+H3" in FIG. 7, the ink jet apparatus, which is driven by a motor for 146 steps (73 steps for H1 and H3 each) in one direction at a frequency of 300 pps, a voltage of 14.0 DCV, and an electric current of 275 mA in normal times, is driven for 73 steps at H1xx and then driven reversely for 73 steps at H2xx for a sequence of "H1+H2+H1+H3" after the ink jet apparatus is left for one week (168 hours) or more, after which "H1"and "H3" were performed for 73 steps, respectively (the other conditions are the same as in the normal times). As a result, the pump is forcedly moved vertically after the ink jet apparatus is left, the sticking of the pump is satisfactorily eliminated, and the pump can be driven.

In a tenth embodiment also, by making the drive sequence of the pulse motor in normal times different from that at the first time after the ink jet apparatus is left to stand more than one week (168 hours), the initial drive sequence after it is left is formed into a sequence having a large impact on the pump. To be specific, at step "H1+H3" in FIG. 7, the ink jet apparatus, which is driven in one direction by a motor for 146 steps (73 steps for H1 and H3 each) at a frequency of 300 pps, a voltage of 14.0 DCV, and an electric current of 275 mA in normal times, is driven in one direction in 146 steps, "H1+H3" is performed after the ink jet apparatus is left for one week (168 hours), after which the pump is moved backward to return to the "standby position", and then "H1+H3" is performed again (the other conditions are the same as in the normal times). As a result, since the pump is forcedly moved vertically after the ink jet apparatus is left, the sticking of the pump is satisfactorily eliminated and the pump can be driven.

In and eleventh embodiment also, by making the drive sequence of the pulse motor in normal times different from that at the first time after the ink jet apparatus is left more than one week (168 hours), the initial drive sequence after the ink jet apparatus is left is formed into a sequence having a large impact on the pump. To be specific, at step "H1+H3" in FIG. 7, the ink jet apparatus, which is driven by a motor for 146 steps in one direction (73 steps for H1 and H3 each) at a frequency of 300 pps, a voltage of 14.0 DCV, and an electric current of 275 mA in normal times, the pump is driven 73 steps at H1 and then driven reversely for 73 steps at H2 for a sequence of "H1+H2+H1+H2+H1+H3". These were repeated again, after which "H1" and "H3" are performed for 73 steps, respectively (the other conditions are the same as in the normal times). As a result, since the pump is forcedly moved vertically after the ink jet apparatus is left, the sticking of the pump is satisfactorily eliminated and the pump can be driven.

A twelfth embodiment is the same as the ninth embodiment except the following. By making the drive frequency of the pulse motor in normal times different from that at the first time after the ink jet apparatus is left more than one week (168 hours), not only the initial pump drive sequence after the ink jet apparatus is left is made different, but also the driving force is increased. To be specific, at step "H1" and "H2" in FIG. 7, the pump is driven with the frequency being decreased to 100 pps after the ink jet apparatus is left for one week (168 hours) (the other conditions are the same as in the normal times). As a result, since not only a drive sequence having a large impact on the pump, but also a large pump driving force can be obtained after the ink jet apparatus is left, the sticking of the pump is satisfactorily eliminated and the pump can be driven.

The apparatus of the above-described embodiments has a battery as an auxiliary power supply, and the timer in the apparatus is able to obtain power from this battery. Thus, it is possible to measure the time that the apparatus is left to stand by means of the timer regardless of the on/off of the power supply of the main body of the apparatus. Although in the above-described embodiments a "week" is used as a reference as regards the predetermined time during which the pump is not driven, the predetermined time is not limited to this example, but various times can be set.

In addition, when each embodiment of the present invention is applied to an ink jet apparatus which performs recording by using ink containing pigments as non-volatile components, it is possible to obtain an ink jet apparatus having high reliability in which the above-described problems do not occur.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded the broadest interpretation, so as to encompass all such modifications, equivalent structures and functions.

What is claimed is:

1. An ink jet apparatus comprising:

a pump for expelling ink from a discharge port of an ink jet head of said apparatus and into said pump, said pump having a plurality of internal surfaces and having a resistance to being driven which is variable with a time during which said pump is not driven, the resistance arising at least in part from deposits of ink on the internal surfaces of said pump; and drive means for varying a driving condition of said pump so as to vary a force with which said pump is driven in accordance with an amount of time during which said pump is not driven, and so as to overcome the resistance, wherein said drive means varies the driving condition of said pump so that the force increases as the amount of time during which said pump is not driven increases.

2. An apparatus according to claim 1, wherein the deposits of ink cause at least one of the plurality of internal surfaces to stick to at least one other of the plurality of internal surfaces.

3. An ink jet apparatus comprising:

a pump for expelling ink from a discharge port of an ink let head of said apparatus and into said pump, said pump having a plurality of internal surfaces and having a resistance to being driven which is variable with a time during which said pump is not driven, the resistance arising at least in part from deposits of ink on the internal surfaces of said pump; and drive means for varying a driving condition of said pump so as to vary a force with which said pump is driven in accordance with the time during which said pump is not driven, and so as to overcome the resistance, wherein said pump includes a cylinder and a piston movable within said cylinder for causing a variation of pressure therein for expelling ink from the discharge port.

4. An ink jet apparatus comprising:

a pump for expelling ink from a discharge port of an ink let head of said apparatus and into said pump, said pump having a plurality of internal surfaces and having a resistance to being driven which is variable with a time during which said pump is not driven, the resistance arising at least in part from deposits of ink on the internal surfaces of said pump; and drive means for varying a driving condition of said pump so as to vary a force with which said pump is driven in accordance with the time during which said pump is not driven, and so as to overcome the resistance, wherein said drive means comprises a motor.

5. An ink jet apparatus according to claim 4, wherein said motor is a pulse motor.

6. An ink jet apparatus according to claim 4, wherein said motor is a pulse motor, and wherein the driving condition includes a drive frequency at which said pulse motor is driven, which is varied by said drive means when the time during which said pump is not driven exceeds a predetermined time.

7. An ink jet recording apparatus according to claim 6, wherein the predetermined time is one week.

8. An ink jet recording apparatus according to claim 7, wherein a normal drive frequency is decreased by said drive means when the drive frequency is varied.

9. An ink jet recording apparatus according to claim 6, wherein a normal drive frequency is decreased to a first level by said drive means when the predetermined time is one week, and is decreased to a second level, lower than the first level, by said drive means when the predetermined time is two weeks.

10. An ink jet apparatus to any one of claims 4 to 6, wherein the driving condition includes a drive voltage at which said motor is driven, which is varied by said drive means when the time during which said pump is not driven exceeds a predetermined time.

11. An ink jet recording apparatus according to claim 10, wherein the predetermined time is one week.

12. An ink jet recording apparatus according to claim 11, wherein the driving condition includes at least one of a normal drive frequency and voltage, which is increased by said drive means.

13. An ink jet apparatus according to any one of claims 4 to 6, wherein the driving condition includes a drive current at which said motor is driven, which is varied by said drive means when the time during which said pump is not driven exceeds a predetermined time.

14. An ink jet apparatus according to claim 13, wherein the driving condition includes a drive voltage at which said motor is driven, which is varied by said drive means when the time during which said pump is not driven exceeds a predetermined time.

15. An ink jet recording apparatus according to claim 14, wherein the predetermined time is one week.

16. An ink jet recording apparatus according to claim 15, wherein the driving condition includes at least one of a normal drive frequency, a normal drive current, and a normal drive voltage, which is increased by said drive means.

17. An ink jet recording apparatus according to claim 13, wherein the predetermined time is one week.

18. An ink jet recording apparatus according to claim 17, wherein the driving condition includes at least one of a normal drive frequency and a normal drive current, which is increased by said drive means.

19. An ink jet apparatus comprising:

a pump for expelling ink from a discharge port of an ink jet head of said apparatus and into said pump, said pump having a plurality of internal surfaces and having a resistance to being driven which is variable with a time during which said pump is not driven, the resistance arising at least in part from deposits of ink on the internal surfaces of said pump; and drive means for varying a driving condition of said pump so as to vary a force with which said pump is driven in accordance with the time during which said pump is not driven, and so as to overcome the resistance, wherein the ink jet head has energy generating means for generating energy used to discharge ink from the discharge port.

20. An ink jet apparatus according to claim 19, wherein the energy generating means is an electro-mechanical conversion member for generating thermal energy.

21. A method of driving an ink jet apparatus, the method comprising the steps of:

providing a pump for expelling ink from a discharge port of an ink jet head and into the pump, the pump having a plurality of internal surfaces and having a resistance to being driven which is variable with a time during which the pump is not driven, the resistance arising at least in part from deposits of ink on the internal surfaces of the pump; and setting a driving condition of the pump so as to vary a force with which the pump is driven in accordance with an amount of time during which the pump is not driven, and so as to overcome the resistance, wherein said setting step sets the driving condition of the pump so that the force increases as the amount of time during which the pump is not driven increases.

22. A method according to claim 21, wherein the deposits of ink cause at least one of the plurality of internal surfaces to stick to at least one other of the plurality of internal surfaces.

23. A method of driving an ink jet apparatus, said method comprising the steps of:

providing a pump for expelling ink from a discharge port of an ink jet head and into said pump, said pump having a plurality of internal surfaces and having a resistance to being driven which is variable with a time during which said pump is not driven, the resistance arising at least in part from deposits of ink on the internal surfaces of said pump; and setting a driving condition of the pump so as to vary a force with which the pump is driven in accordance with the time during which the pump is not driven, and so as to overcome the resistance, wherein the driving condition includes a drive frequency at which a motor for driving the pump is driven.

24. A method of driving an ink jet apparatus, said method comprising the steps of:

providing a pump for expelling ink from a discharge port of an ink Set head and into the pump, the pump having a plurality of internal surfaces and having a resistance to being driven which is variable with a time during which the pump is not driven, the resistance arising at least in part from deposits of ink on the internal surfaces of the pump; and setting a driving condition of the pump so as to vary a force with which the pump is driven in accordance with the time during which the pump is not driven, and so as to overcome the resistance, wherein the drive condition includes a drive voltage at which a motor for driving the pump is driven.

25. A method of driving an ink jet apparatus, said method comprising the steps of:

providing a pump for expelling ink from a discharge port of an ink jet head and into the pump, the pump having a plurality of internal surfaces and having a resistance to being driven which is variable with a time during which the pump is not driven, the resistance arising at least in part from deposits of ink on the internal surfaces of the pump; and setting a driving condition of the pump so as to vary a force with which the pump is driven in accordance with the time during which the pump is not driven, and so as to overcome the resistance, wherein the driving condition includes a drive current at which a motor for driving the pump is driven.

26. An ink jet apparatus according to claim 25, wherein the driving condition includes a drive voltage at which a motor for driving said pump is driven.

27. An ink jet apparatus comprising:

a pump for expelling ink from a discharge port of an ink jet head of said apparatus and into said pump, said pump having a plurality of internal surfaces and having a resistance to being driven which is variable with a time during which said pump is not driven, the resistance arising at least in part from deposits of ink on the internal surfaces of said pump; and drive means for varying a drive sequence of said pump so as to vary a driving scale with which said pump is driven in accordance with an amount of time during which said pump is not driven, and so as to overcome the resistance, wherein said drive means varies the drive sequence of said pump so that the driving scale increases as the amount of time during which said pump is not driven increases.

28. An ink jet apparatus according to claim 27, wherein said drive means varies a driving condition of said pump so as to vary a force with which said pump is driven in accordance with the time during which said pump is not driven.

29. An apparatus according to claim 27, wherein the deposits of ink cause at least one of the plurality of internal surfaces to stick to at least one other of the plurality of internal surfaces.

30. An ink jet apparatus comprising:

a pump for expelling ink from a discharge port of an ink jet head of said apparatus and into said pump, said pump having a plurality of internal surfaces and having a resistance to being driven which is variable with a time during which said pump is not driven, the resistance arising at least in part from deposits of ink on the internal surfaces of said pump; and drive means for varying a drive sequence of said pump so as to vary a driving scale with which said pump is driven in accordance with the time during which said pump is not driven, and so as to overcome the resistance, wherein said pump includes a cylinder and a piston movable within said cylinder for causing a variation of pressure therein for expelling ink from the discharge port.

31. An ink jet apparatus comprising:

a pump for expelling ink from a discharge port of an ink jet head of said apparatus and into said pump, said pump having a plurality of internal surfaces and having a resistance to being driven which is variable with a time during which said pump is not driven, the resistance arising at least in part from deposits of ink on the internal surfaces of said pump; and drive means for varying a drive sequence of said pump so as to vary a driving scale with which said pump is driven in accordance with the time during which said pump is not driven, and so as to overcome the resistance, wherein said drive means comprises a motor.

32. An ink jet apparatus according to claim 31, wherein said motor is a pulse motor.

33. An ink jet apparatus according to any one of claims 27 to 32, wherein when said pump is not driven for a predetermined time, at least a part of a normal drive sequence of said pump is repeated.

34. An ink jet apparatus according to any one of claims 27 to 32, wherein the ink jet head has energy generating means for generating energy used to discharge ink from the discharge port.

35. An ink jet apparatus according to claim 34, wherein the energy generating means is an electromechanical conversion member for generating thermal energy.

36. A method of driving an ink jet apparatus, said method comprising the steps of:

providing a pump for expelling ink from a discharge port of an ink jet head and into the pump, the pump having a plurality of internal surfaces and having a resistance to being driven which is variable with a time during which the pump is not driven, the resistance arising at least in part from deposits of ink on the internal surfaces of the pump; and setting a drive sequence of the pump so as to vary a driving scale with which the pump is driven in accordance with an amount of time during which the pump is not driven, and so as to overcome the resistance, wherein said setting step sets the drive sequence of the pump so that the driving scale increases as the amount of time during which the pump is not driven increases.

37. A method according to claim 36, wherein the deposits of ink cause at least one of the plurality of internal surfaces to stick to at least one other of the plurality of internal surfaces.

* * * * *

UNITED STATES PATENT AND TRADEMARK OFFICE

CERTIFICATE OF CORRECTION

PATENT NO. : 6,050,668
DATED : April 18, 2000
INVENTOR(S) : Masaharu Ikado

It is certified that error appears in the above-identified patent and that said Letters Patent is hereby corrected as shown below:

Column 1:
Line 30, "the thickened" should read -- thickened --; and
Line 45, "ink" should read -- ink, --.

Column 2:
Line 51, "another embodiment" should be deleted.

Column 5:
Line 23, "an" should read -- a --.

Column 6:
Lines 15 and 56, "after" should be deleted.

Column 7:
Line 25, "obtained" should read -- obtained, --.

Column 8:
Lines 29, 46 and 65, "are" should read -- being --; and
Line 52, "and" should read -- an --.

Column 9:
Line 11, "are" should read -- being --; and
Line 67, "let" should read -- jet --.

Column 10:
Line 16, "let" should read -- jet --; and
Line 47, "apparatus" should read -- apparatus according --.

Column 12:
Line 2, "Set" should read -- jet --; and
Line 32, "An" should read -- A method of driving an --.

UNITED STATES PATENT AND TRADEMARK OFFICE

CERTIFICATE OF CORRECTION

PATENT NO. : 6,050,668
DATED : April 18, 2000
INVENTOR(S) : Masaharu Ikado

It is certified that error appears in the above-identified patent and that said Letters Patent is hereby corrected as shown below:

Column 13:
Line 33, "to 32," should read -- and 30 to 32, --.

Column 14:
Line 4, "to 32," should read -- and 30 to 32, --.

Signed and Sealed this

Ninth Day of October, 2001

*Attest:*

Nicholas P. Godici

*Attesting Officer*

NICHOLAS P. GODICI
*Acting Director of the United States Patent and Trademark Office*